United States Patent [19]

Heintzmann et al.

[11] Patent Number: 4,630,973

[45] Date of Patent: Dec. 23, 1986

[54] PERIPHERALLY FLEXIBLE PROP ARCH FOR MINING TRACKS, TUNNELS OR THE LIKE

[75] Inventors: Peter Heintzmann, Bochum; Manfred Koppers, Duisberg; Karlheinz Bohnes, Bochum; Lothar Domanski, Oberhausen, all of Fed. Rep. of Germany

[73] Assignee: Bochumer Eisenhuette Heintzmann GmbH & Co. KG, Bochum, Fed. Rep. of Germany

[21] Appl. No.: 617,522

[22] Filed: Jun. 4, 1984

[30] Foreign Application Priority Data

Jun. 9, 1983 [DE] Fed. Rep. of Germany ..... 3320829

[51] Int. Cl.[4] ..... E21D 11/18

[52] U.S. Cl. ..... 405/288

[58] Field of Search ..... 405/288–290; 248/354.1, 354.3, 354.4

[56] References Cited

U.S. PATENT DOCUMENTS

| | | | |
|---|---|---|---|
| 2,713,774 | 7/1955 | Heintzmann et al. | 405/288 |
| 2,793,719 | 5/1957 | Langerbein | 405/288 X |
| 3,076,672 | 2/1963 | Heintzmann et al. | 405/288 X |

FOREIGN PATENT DOCUMENTS

| | | | |
|---|---|---|---|
| 177745 | 2/1954 | Austria | 405/288 |
| 618783 | 9/1935 | Fed. Rep. of Germany . | |
| K11585 | 12/1953 | Fed. Rep. of Germany . | |
| 1410 | 12/1956 | Fed. Rep. of Germany | 405/288 |
| 1170889 | 5/1964 | Fed. Rep. of Germany | 405/288 |
| 1171857 | 6/1964 | Fed. Rep. of Germany | 405/288 |
| 2029862 | 7/1977 | Fed. Rep. of Germany | 405/288 |
| 1054550 | 1/1967 | United Kingdom | 405/288 |

*Primary Examiner*—Cornelius J. Husar
*Assistant Examiner*—Nancy J. Stodola
*Attorney, Agent, or Firm*—Michael J. Striker

[57] ABSTRACT

A peripherally flexible arch for propping rock structure for mining tracks, tunnels or the like is comprised of a plurality of partially overlapped elongated segments, each of which has an end portion extended toward the rock structure, a bottom portion opposite to the end portion, and a lateral flange offset from the end portion laterally and in the direction toward the bottom portion. Clamping devices are arranged at the ends of the overlapping regions of the segments to clamp the segments to each other. The end portion of each lower segment is inserted into a groove formed between the end portion and the flange portion of each upper segment at the side of this segment facing away from the rock structure. Each clamping device has a hook engaged in a groove formed between the end portion and the flange of the upper segment at the side of this segment facing toward the rock structure.

12 Claims, 5 Drawing Figures

PERIPHERALLY FLEXIBLE PROP ARCH FOR MINING TRACKS, TUNNELS OR THE LIKE

BACKGROUND OF THE INVENTION

The present invention relates to peripherally flexible prop arches utilized in mining tracks, tunnels or the like.

Conventional peripherally flexible prop arches for a so called quandrant construction take up transverse forces resulted from bending loads which occur in the region of the connecting means of overlapping or superimposing gutter-profiled segments of the prop arch and produce against those forces or in connection with the flanges of only one gutter-shaped segment so called slide-in retarding forces of a required slide-in resistance.

In order to translate transverse and normal forces acting on the connecting means between the overlapping segments of the prop arch, which connection means is formed as a clamping device, the gutter-shaped segments have been made either cast formed, or the hook-like clamping device have been employed, which engaged with the flanges of the gutter-shaped segments. Both solutions, when utilized in practice, have the disadvantage that the segments of the prop arch in the region of the engagement with the clamping devices were supported not immediately against the rock structure and not between the rock structure surface and the support surface but the flanges of the clamping device were positioned between the flanges of the radially outwardly extended flanges of the segments of the arch and the rock structure. This led, during the insertion or sliding-in of the segments of the prop arch between the rock ceiling and the supporting floor, to a considerable and uncertain influence of the slide-in resistance which could result in a partial or total damage of the clamping device.

During the insertion of the peripherally flexible prop arch into a mining track with a strong pressure loading the arch is usually backfilled with a suitable construction material to improve supporting properties of the arch. To prevent an undesired rigidity of the prop arch it has been required to provide respective hollows in the backfilling material surrounding the arch, which has been labor-consuming and costly This auxiliary means, however has not totally eliminated the above noted disadvantages of conventional prop arches, in which the flanges of the gutter-shaped segments are engaged with the clamping devices so that these clamping devices remain hung on those flanges during the slide-in movement of the segments so that a further sliding-in movement becomes difficult or is blocked and in this case the peripheral flexibility of the prop arch is questioned.

One of flexible prop arches comprised of a plurality of gutter-shaped segments is disclosed in German patent publication No. K 11 585 5c, 9/10 published Dec. 17, 1953. The disadvantages of the known peripherally flexible arches are partially avoided in the above German publication in that the yokes of the clamping devices are engaged in the corresponding depressions of the flange end of the upper gutter-shaped segment in the region of the overlapping of the segments and the yokes do not overlay the flange ends directed toward the rock ceiling and thereby sliding of the arch along the rock is facilitated and it is ensured at the same time that the clamping devices during the insertion of the arch move together with the end of the inwardly positioned or upper gutter-shaped segment and specific auxiliary devices for this purpose are no longer necessary.

The basic shortcoming of the above described solution is that such a means is not secondary or additional when the yoke of the clamping device can be applied onto the overlapping ends of the segments because this yoke must slide on those ends to become engaged with the inwardly positioned or upper segment of the arch. Because of the necessity of such handling of the clamping device and because of the lowering of the rock, a significant relative displacement of the clamping device and the segments of the arch being clamped occurs, and the above discussed problem encountered in conventional arches remains generally unsolved, and such an arch has the disadvantage that the yoke of the clamping device, engaged with the flange of the inwardly positioned segment lies between the arch and the rock structure, and the slide-in ratio remains uncertain or uncontrollable because of an undesired increase of the given slide-in resistance.

SUMMARY OF THE INVENTION

It is an object of the present invention to provide an improved peripherally flexible prop arch in which it will be ensured that the clamping devices could not be applied directly to the rock structure or the backfill material and the given peripheral flexibility of the arch would not be unfavorably affected.

This and other objects of the invention are attained by a peripherally flexible prop arch for mining tracks, tunnels or the like for propping a rock structure or a backfill material, comprising at least two elongated gutter-shaped segments partially overlapping one another to define an overlapping region and having end portions superposed one on another and extended in the same direction and having congruent cross sections; clamping devices applied to said segments at said overlapping region to clamp said segments to each other, the end portion of each segment being directed toward the rock structure and having an end, each segment further having a bottom portion directed away from the rock structure and a lateral flange offset from said end portion in the direction toward said bottom portion, each flange being formed with a first elongated groove facing and open toward said rock structure and extended along the elongation of the segment and an opposite second elongated groove facing toward said bottom portion, each clamping device including a hook-like portion engaged in said first groove and a claw-shaped portion engaged in said second groove, the lateral flange of each segment including a flange edge portion extended toward the rock structure and limiting said first groove from outside, said edge portion being spaced from said end of the end portion in the direction toward said bottom portion at least such a distance that the hook-like portion of each clamping device is engaged with said edge portion and said hook-like portion does not extend beyond the end of the end portion of said one segment in the direction toward said rock structure at any place along the elongation of said one segment.

The end portion of the another segment may be inserted into the end portion of said one segment.

A prop arch comprised of non-congruent gutter-shaped segments which have different cross sections is disclosed, for example in German patent DE-PS No. 618,783. In this known construction the flanges of the inwardly positioned gutter-shaped segment are oblique and step-like and are supported so that the flanges of the clamping devices engaging with the flanges of the adjacent segments in the region of overlapping of the segments do not extend beyond the flange edges of the segments. The partial insertion of the clamping arm of each clamping device into the respective rebound at the flange end does not solve the problem of conventional arches since in the case of the conventional arch the bottom portions of the segments and not the flanges extend toward the rock so that this known solution does not fulfill the purpose of the present invention.

In the prop arch according to the present invention the gutter-shaped segments are congruent and the hook-like or jaw-shaped end portions of the clamping devices engaged in the respective elongated grooves in the flanges of the arch segments in no case extend beyond the ends of the flanges toward the rock structure or rock surface, and therefore a sliding-in movement or insertion of the arch would not be prevented by the rock structure, or a backfill material or the warping, and the given flexibility and thus required slide-in resistance of the arch would not be affected.

Although the flanges of the segments should not have necessarily a single predetermined shape within the limits of the present invention these flanges can be formed so that bending properties of the gutter-shaped segments would be optional in accordance with contemporary standards.

The construction of the clamping device is also not limited by a specific structure but it should, however, ensure that the hook-like projections of the clamping device, engaged in the elongated grooves open toward the rock structure must be dimensioned so that they in no case would extend beyond the far reaching projected flange end, and therefore during the insertion or sliding-in of the arch into the mining track no collision of the arch with the rock structure or backfill material would occur.

The invention does not depend on whether the given slide-in resistance is exclusively or predominantly controlled by the clamping devices or additionally in the known fashion because outside of the overlapping region the clamping means increased by the slide-in resistance is applied onto the flanges of only one of the two gutter-shaped segments, against which the front end of the respective another segment is supported against the slide-in movement.

According to a further feature of the present invention the lateral flange may have a cross section of a hammer head, each segment further including a transition portion extended between the end portion and the lateral flange whereby said first groove and second groove are defined between said end portion and said flange at two opposite sides of said transition portion. The hammer head-shaped flange of each segment has a thicker wall than that of the transition portion, and the transition portion forms a cross piece between the lateral flange and the end portion of each arch segment.

The lateral flange of each segment may have another edge portion opposite to said first mentioned flange edge portion and extended toward said bottom portion. Said another edge portion of the lateral flange of said one segment may be immediately positioned in the first mentioned flange edge portion of said another segment.

It is advantageous that said one segment may be immediately supported on said another segment in the overlapping region so that the end portion of said another or lower segment is engaged in the second groove of said one or upper segment.

According to still another feature of this invention the flange edge portion of the flange of each segment may be hook-shaped and forms on said lateral flange at the side of said second groove a curved abutment surface, said abutment surface limiting the second groove in the flange portion of each segment.

Furthermore, said another or lower segment may be spaced from said one segment in the direction away from the rock structure and define a space therebetween and wherein an adapter is provided inserted into said space in said overlapping region, said adapter having a contour corresponding to that of said space so that said one segment is supported on said another segment by means of the adapter. In this case a reliable engagement of the clamping devices and the segments with each other during the sliding-in process is ensured. The adapter can be coupled to the gutter-shaped segments, for example by welding.

According to yet another feature of the invention the adapter may have a tie rod which in the direction toward the rock structure does not extend over the end of the end portion of said one segment at any position along the length of said one segment.

Each clamping device may further include a plate having said claw-shaped portion and a bolt extended through said plate and having said hook-like portion, said plate and said bolt being so dimensioned that they do not extend in the direction of the rock structure beyond the end of said one segment at any position along the length of said one segment.

The steel tie or pulling rods or bands serve not only the purpose of engaging the adapter with the clamping device but also the purpose of preventing the splitting of the arch segments under the action of bending loads, and it is also advantageous that the clamping devices or adapter parts in no case extend beyond the end of the uppermost segment in the direction toward the rock structure.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. is a sectional view through two gutter-profiled superimposed segments of the flexible arch structure in the region of the clamping device.

DETAILED DESCRIPTION OF THE PREFERRED EMBODIMENTS

Figure 1:
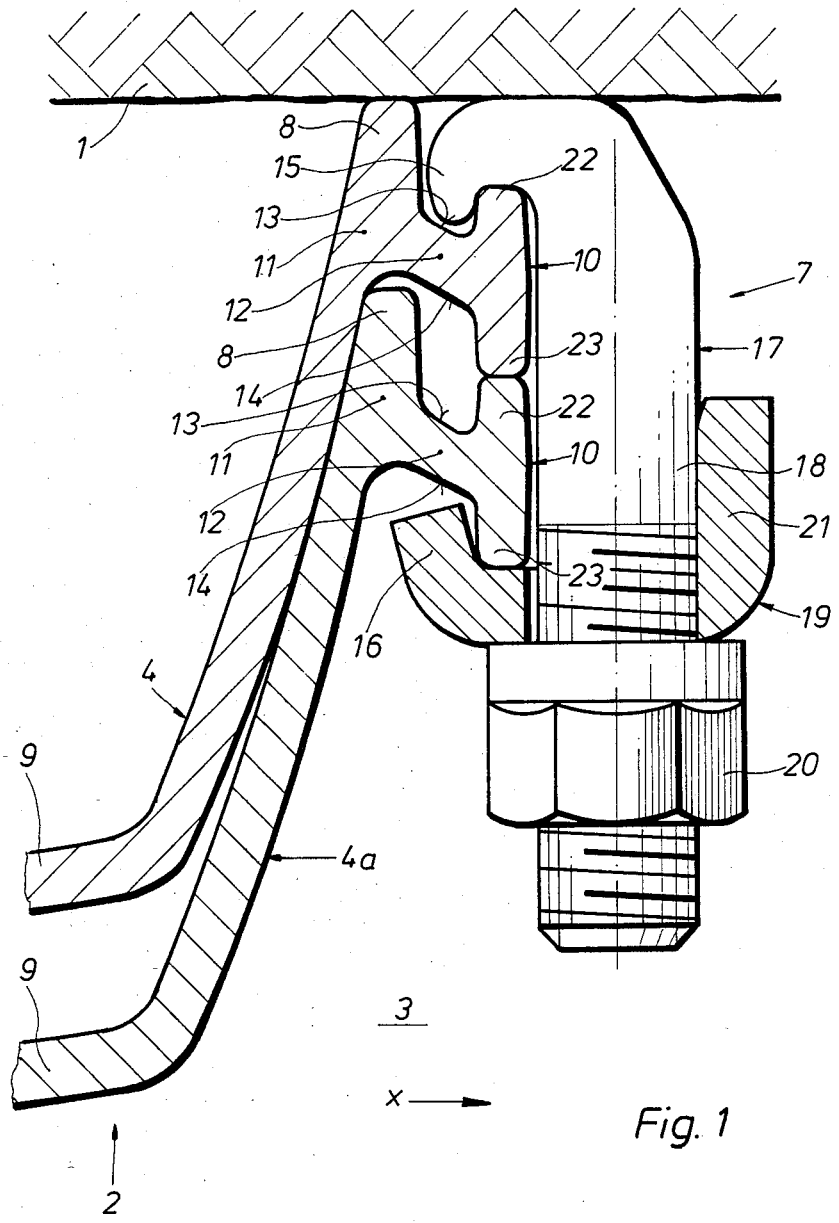

Referring now to the drawings in detail and first to FIG. 1, it will be seen that reference numeral 1 designates a rock structure propped by means of peripherally flexible extension arches 2 arranged at intervals from each other in the rock, in which a mining track 3 is driven. The direction of the mining track 3 is identified by an arrow X.

Extension or prop arches 2 are comprised of a plurality of elongated double webbed gutter-profiled segments 4, 4*a*, of a substantially U-shaped congruent cross section. The end portions of the gutter-profiled segments 4, 4*a* . . . following one after another in the peripheral direction of mining track 3 lie one within another and extend in the same direction in the regions of overlapping. These end portions inserted one into another in the regions of overlapping are clamped to each other by clamping devices 7. The clamping devices 7 are positioned respectively at the ends of the overlapping regions and are supported only against one longitudinal side of the respective gutter-profiled segment 4, 4*a* . . . .

In the embodiment shown in FIG. 1 vertically projecting flanges 11 with the end portions 8 of the segments 4, 4*a* . . . have lateral flange portions 10 projected in the direction opposite to that of the bottom portions 9 of segments 4, 4*a*, and radially offset with respect to the rock structure 1. Lateral flange portions 10 are hammer-shaped and each forms, together with a respective transition portion 12 and the assigned vertical flange portion 11, an elongated groove 13 at the side facing toward the rock structure and an elongated groove 14 at the side of the respective segment, facing away from the rock structure 1. Elongated grooves 13, 14 engage projections 15 of claws 16 of the clamping devices 7.

Each clamping device 7 is comprised of a hook-like bolt 17 and a U-shaped claw plate 19, through which bolt 17 extends and to which this bolt is clamped by a clamping nut 20. The claw plate 19 has a leg 21, which lies against the side of bolt 17, facing away from gutter-profiled segment 4, 4*a* . . . and the claw 16 engaged in groove 14 of the segment 4*a* as mentioned above.

The construction of the hammer-head-shaped, enlarged lateral portion 10 is such that the groove 13, which is open toward rock structure 1, is laterally limited by an edge projection 22 extended toward the rock structure 1 and being spaced radially, e.g. in the direction of the bottom 9 from the far reaching flange end 8 at least such a distance that the clamping projection 15 of screw 17 engaged with the projection 22 of the segment 4 does not extend over the far reaching flange end 8 of the segment 9 at any place along the length of segment 4, which is the uppermost segment in the prop arch construction.

Figure 2:
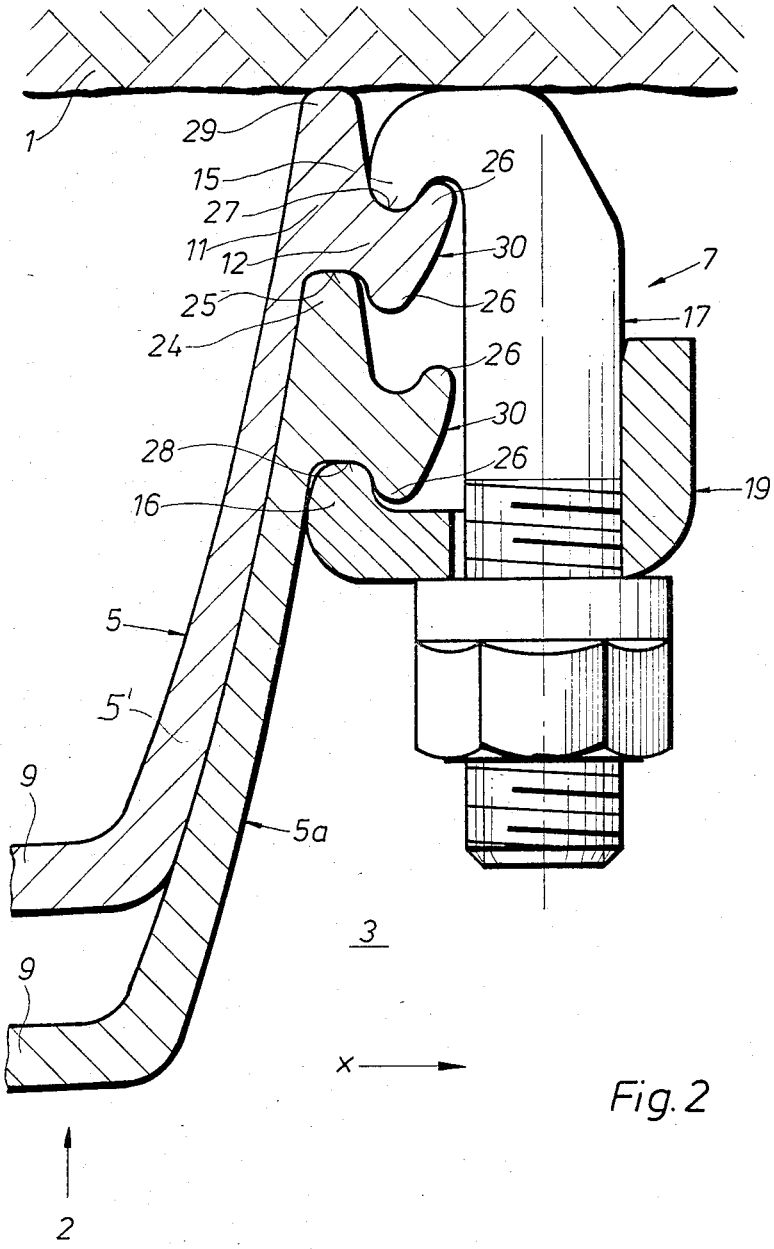
FIG. 2 is a sectional view through two gutter-profiled segments of the flexible arch, clamped to each other, of another embodiment of the invention.

With reference to FIG. 2 it will be seen that two gutter-profiled segments 5 and 5*a* of the plurality of such segments, positioned one in the other, are shown. Each segment 5, 5*a* . . . has, similarly to the embodiment of FIG. 1, an upper flange portion 11, a bar section 5' and a bottom portion 9. If the lateral flange portions 10 of two superimposed segments 4, 4*a* in FIG. 1 lie one on the other in the region of projections 22 and 23, but the flange portions 11 with end portions 8 do not abut against each other but are rather spaced from each other in the direction normal to arrow X, the flange end portion 24 abuts against the lower surface formed by a lower groove 25 so that the flange end portions of adjacent segments are immediately supported one in the other. Thus the far reaching end portion 24 is engaged in groove 25 of flange portion 11 facing away from rock structure 1. The lateral flange portions 26, however, do not abut against each other but spaced from each other. The clamping device 7 of the embodiment of FIG. 2 is similar to that of FIG. 1 except for the claw 16 which is fully engaged in the clamped groove 28 of the gutter-profiled segment 5*a*. Clamping projection 15 of the hook-like screw 17 is in turn engaged in the elongated groove 27 of segment 5. Similarly to the embodiment of FIG. 1, clamping projection or nose 15 does not extend over the flange end portion 29 of the uppermost segment 5 Lateral hammer head-shaped flange portion 30 is respectively spaced from the profile bottom 9.

Figure 3:
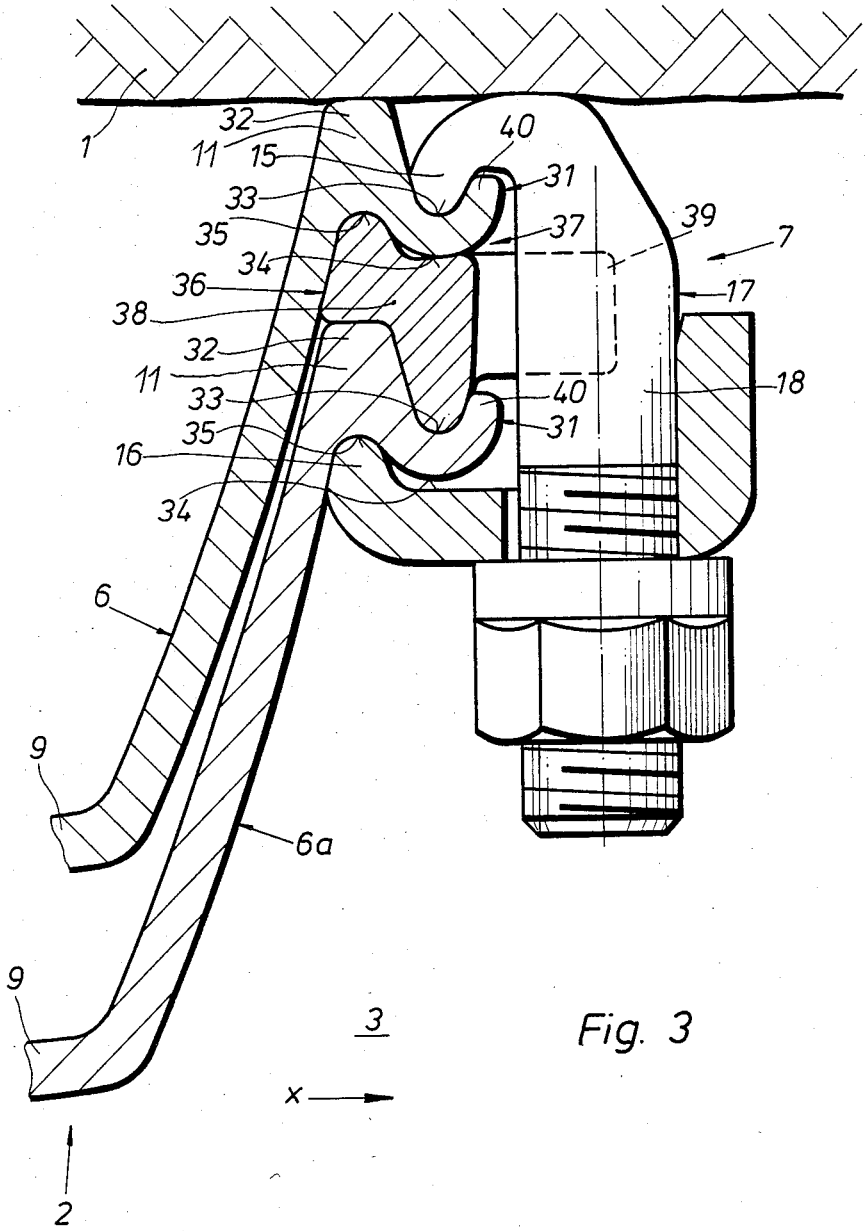
FIG. 3 is a sectional view through the flexible arch of a further embodiment of the invention.

Reference is now made to FIG. 3. Two gutter profiled segments 6 and 6*a*, out of a plurality of identical superimposed and inserted one into another segments forming the prop arch structure are shown Each segment 6, 6*a* has vertical flange portion 11 and a lateral outwardly extended flange portion 31 Each lateral flange portion 31 is radially, e.g. in the direction toward the profile bottom 9, offset or spaced from the flange end 32 of flange portion 11 abutting against the surface of the rock and has a hook-like or bent off cross section. Thereby an elongated groove 33 facing toward and open toward the rock structure is formed by the book-shaped flange portion 31 whereas on the opposite side of the lateral flange portion 31 of each segment facing away from rock 1, a curved abutment surface 34 is produced, which limits an elongated groove 35.

It is also possible with the embodiment of FIG. 3 that the end portions 32 of the vertical flange portions 11 be supported immediately one on the other. As shown in FIG. 3 an adapter 36, however, can be inserted between two adjacent segments 6 and 6*a* in the region of their superimposing. Adapter 36 has a contour or outline which corresponds to the shape of the space or recess 37 formed between the lower surface of the flange portions 11 and 31 of the uppermost segment 6 and the upper surface of the flange portions 11 and 31 of the lower adjacent segment 6*a*.

Figure 4:
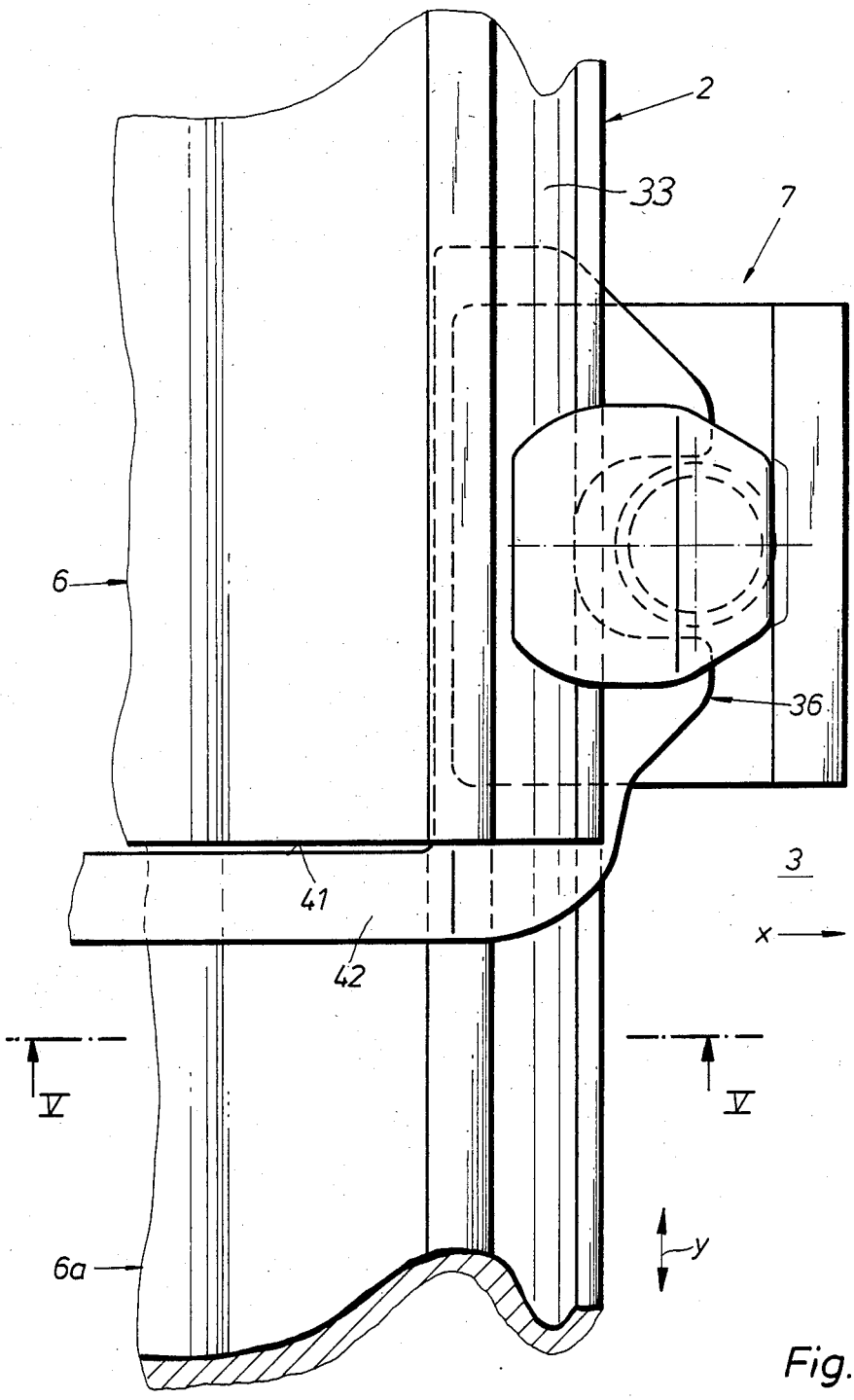
FIG. 4 is a top plan view of the rock structure with the gutter-profiled segments of the flexible arch of the embodiment of FIG. 3.

Each adapter 36 has a somewhat U-shaped construction and is formed of a thickened cross piece 38 of the contour corresponding to that of space 37 and two arms 39 extended from the cross piece 38 so as to embrace the shaft 18 of the hook-like bolt 17 as seen in FIG. 4. The hook-like bolt 17 in the embodiment of FIG. 3 as well as hook-shaped projection 15 and nut 20 of the clamping device 7 correspond to those of the embodiments of FIGS. 1 and 2. The flange projection or edge 40 of the lateral flange portion 31 of each segment of the arch structure is offset from the end 32 of the vertical flange portion 11 in the direction toward the profile bottom 9 so that the hook or clamping projection 15 of each bolt 17 of the clamping device, engaged in groove 33, does not extend over the flange end 32 of segment 6 in the direction toward rock structure 1.

Each adapter 36 can be loosely inserted between the flange portions of the adjacent segments. It is also conceivable that each adapter 36 be coupled with the two adjacent segments in the engaging fashion. Such a coupling can be obtained, for example by welding.

Figure 5:
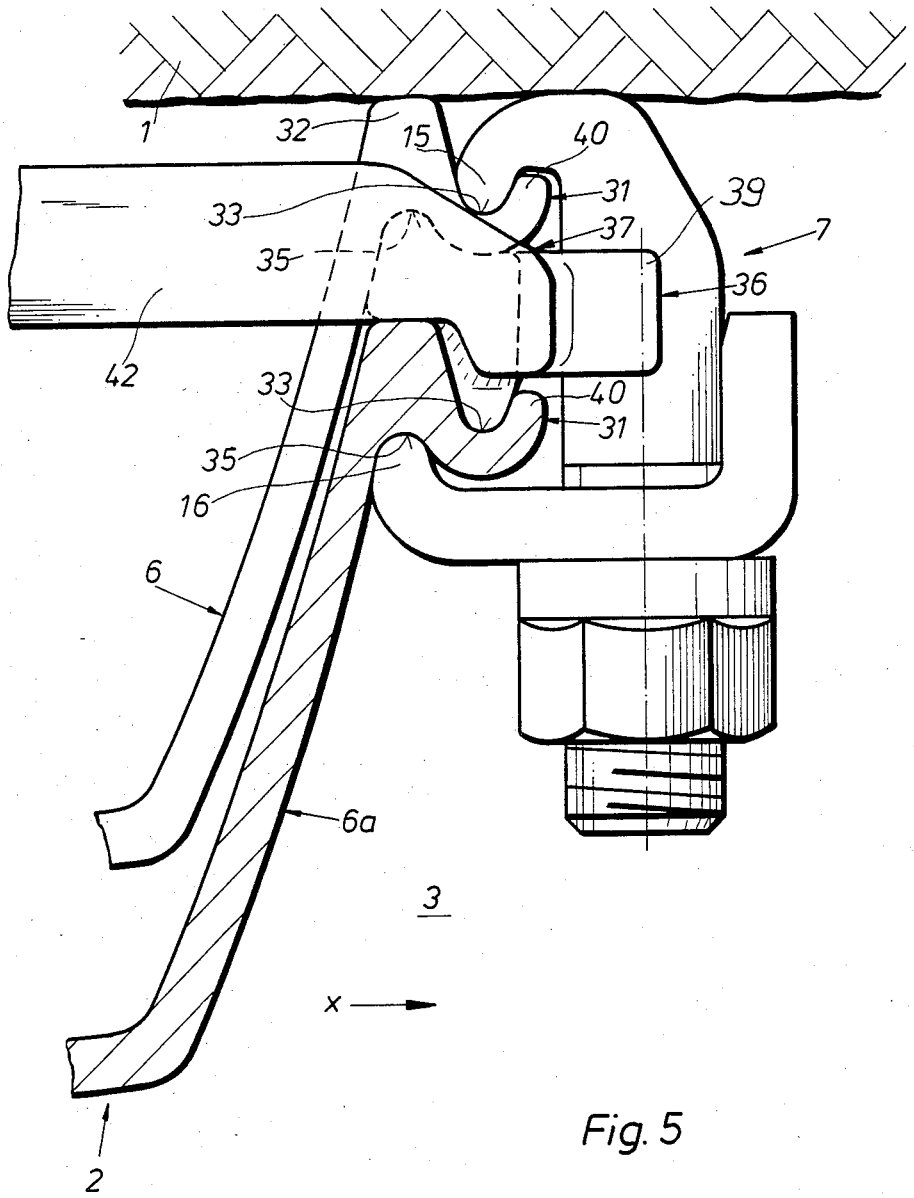
FIG. 5 is a cross section taken along line V—V of FIG. 4.

With reference to FIGS. 4 and 5 it will be seen that segments 6 and 6*a* partially overlap each other in the direction of elongation shown by arrow Y and each adapter 36 is inserted between two overlapped segments 6 and 6*a* so that a face 41 of a tie rod 42 of the adapter is positioned in the vertical direction against the respective face of segment 6. The tie rods 42 of the adapters 36 also do not extend radially in the direction of the rock structure 1 beyond the end 32 of the uppermost segment 6. Tie rods 42 of the adapters 36 merely lie against the end faces of the respective segments while the arms 39 of the adapters engage or embrace the shafts 18 of the respective clamping devices 7 upon the relative displacement of the gutter-profiled segments 6, 6*a*. A splitting of the segments 6, 6*a* under the action of bending loads is at the same time prevented.

It will be understood that each of the elements described above, or two or more together, may also find a useful application in other types of peripherally flexible propping arch structures for mining tracks or the like differing from the types described above.

While the invention has been illustrated and described as embodied in a peripherally flexible prop arch for mining tracks or tunnels, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A peripherally flexible prop arch for mining tracks, tunnels or the like for propping a rock structure or a backfill material, comprising at least two elongated gutter-shaped segments partially overlapping one another to define an overlapping region and having end portions superposed one on another and extended in the same direction and having congruent cross sections; and clamping devices each applied to said segments at said overlapping region to clamp said segments to each other, the end portion of each segment being directed toward the rock structure and having an end, each segment further having a bottom portion directed away from the rock structure and a lateral flange offset from said end portion in the direction toward said bottom portion, each flange being formed with a first elongated groove facing and open toward said rock structure and extended along the elongation of the segment and an opposite second elongated groove facing toward said bottom portion, each clamping device including at an upper end thereof facing the rock structure a hook designed so as to completely fill said first groove and engaged in said firs groove, and at a lower end thereof a claw-shaped portion engaged in said second groove, the lateral flange of each segment including a flange edge portion extended toward the rock structure and limiting said first groove from outside, said edge portion being spaced from said end of the end portion in the direction toward said bottom portion at least such a distance that the hook of said clamping device is engaged with said edge portion and said hook does not extend beyond the end of the end portion of said one segment in the direction toward said rock structure at any place along the elongation of said one segment.

2. The prop arch as defined in claim 1, wherein the end portion of the another segment is inserted into the end portion of said one segment.

3. The prop arch as defined in claim 1, wherein said lateral flange has a cross section of a hammer head, each segment further including a transition portion extended between the end portion and the lateral flange whereby said first groove and second groove are defined between said end portion and said flange edge portion at two opposite sides of said transition portion.

4. The prop arch as defined in claim 3, wherein said lateral flange of each segment has another edge portion opposite to said first mentioned flange edge portion and extended toward said bottom portion.

5. The prop arch as defined in claim 4, wherein said another edge portion of the lateral flange of said one segment is immediately positioned on the first mentioned flange edge portion of said another segment.

6. The prop arch as defined in claim 4, wherein said one segment is immediately supported on said another segment in the overlapping region and the end portion of said another segment is engaged in said second groove of said one segment.

7. The prop arch as defined in claim 1, wherein said flange edge portion is hook-shaped and forms on said lateral flange at the side of said second groove a curved abutment surface.

8. The prop arch as defined in claim 1, wherein said another segment is spaced from said one segment in the direction away from the rock structure to define a space therebetween and wherein an adapter is provided inserted into said space in said overlapping region, said adapter having a contour corresponding to that of said space so that said one segment is supported on said another segment by means of said adapter.

9. The prop arch as defined in claim 8, wherein said adapter is engagingly coupled with said one segment and said another segment.

10. The prop arch as defined in claim 9, wherein said adapter has a pulling rod which in the direction toward the rock structure does not extend over the end of the end portion of said one segment at any position along the length of said one segment.

11. The prop arch as defined in claim 1, wherein each clamping device further includes a plate having said claw-shaped portion and a bolt extended through said plate and having said hook, said plate and said bolt being so dimensioned that they do not extend in the direction of the rock structure beyond the end of said one segment at any position along the length of said one segment.

12. A peripherally flexible prop arch for mining tracks, tunnels or the like for propping a rock structure or a backfill material, comprising at least two elongated gutter-shaped semgents partially overlapping one another to define an overlapping region and having end portions superposed one on another and extended in the same direction and having congruent cross sections, one of said segments having a segment projection while the other of said projection segments has a segment groove; and clamping devices each applied to said segments at said overlapping region to clamp said segments to each other, the end portion of each segment being directed toward the rock structure and having an end, each segment further having a bottom portion directed away from the rock structure and a lateral flange offset from said end portion in the direction toward said bottom portion, each flange being formed with a first elongated groove facing and open toward said rock structure and extended along the elongation of the segment and an opposite second elongated groove facing toward said bottom portion, each clamping device includng at an upper end thereof facing the rock structure a hook designed so as to completely fill said first groove and engage in said first groove, and at a lower end thereof a claw-shaped portion engaged in said second groove, so as to completely fill said second groove in a clamped condition in which said segment projection of said one segment engages in and completely fills said segment groove of said other segment, the lateral flange of said segment including a flange edge portion extended toward the rock structure and limiting said first groove from outside, said edge portion being spaced from said end of the end portion in the direction toward said bottom portion at least such a distance that the hook of each clamping device is engaged with said edge portion and said hook does not extend beyond the end of the end portion of said one segment in the direction toward said rock structure at any place along the elongation of said one segment.

* * * * *